US006324804B1

(12) United States Patent
Hoogstraten

(10) Patent No.: US 6,324,804 B1
(45) Date of Patent: Dec. 4, 2001

(54) CONCRETE WALL FORMING SYSTEM

(75) Inventor: Jack Hoogstraten, Alberta (CA)

(73) Assignee: Plasti_FAB (division of PFB Corporation), Calgary (CA)

( * ) Notice: Subject to any disclaimer, the term of this patent is extended or adjusted under 35 U.S.C. 154(b) by 0 days.

(21) Appl. No.: 09/298,438

(22) Filed: Apr. 23, 1999

Related U.S. Application Data

(60) Provisional application No. 60/116,201, filed on Jan. 15, 1999.

(51) Int. Cl.[7] ..... E04C 1/00

(52) U.S. Cl. ..... 52/426; 52/309.12; 52/270; 52/309.11; 52/275; 249/191; 249/47; 249/194

(58) Field of Search ..... 52/275, 425, 426, 52/562, 285.1; 249/191, 47, 194, 216; 403/231, 402

(56) References Cited

U.S. PATENT DOCUMENTS

| | | | | |
|---|---|---|---|---|
| D. 361,710 | | 8/1995 | Boeshart | D8/354 |
| D. 378,049 | | 2/1997 | Boeshart | D8/354 |
| D. 383,373 | | 9/1997 | Boeshart | D8/354 |
| 3,902,296 | | 9/1975 | Thomas | 52/747 |
| 4,646,496 | | 3/1987 | Wilnau | 52/252 |
| 4,730,422 | | 3/1988 | Young | 52/105 |
| 4,731,968 | | 3/1988 | Obino | 52/309.12 |
| 4,765,109 | | 8/1988 | Boeshart | 52/426 |
| 4,791,767 | | 12/1988 | Boeshart | 52/426 |
| 4,884,382 | | 12/1989 | Horobin | 52/426 |
| 4,889,310 | | 12/1989 | Boeshart | 240/41 |
| 4,916,879 | * | 4/1990 | Boeshart | 52/426 |
| 4,936,540 | | 6/1990 | Boeshart | 249/216 |
| 4,938,449 | | 7/1990 | Boeshart | 249/216 |
| 5,039,058 | | 8/1991 | Boeshart | 249/194 |
| 5,065,561 | | 11/1991 | Mason | 52/309 |
| 5,194,323 | | 3/1993 | Savoy | 428/305.5 |
| 5,209,039 | | 5/1993 | Boeshart | 52/699 |
| 5,270,108 | | 12/1993 | Savoy | 428/305.5 |
| 5,390,459 | | 2/1995 | Mensen | 52/426 |
| 5,497,592 | | 3/1996 | Boeshart | 52/699 |
| 5,524,400 | | 6/1996 | Schmechel | 52/474 |
| 5,566,518 | | 10/1996 | Martin et al. | 52/426 |
| 5,649,401 | | 7/1997 | Harrington | 52/426 |
| 5,658,483 | * | 8/1997 | Boeshart | 249/191 |
| 5,704,180 | | 1/1998 | Boeck | 52/426 |

(List continued on next page.)

FOREIGN PATENT DOCUMENTS

| | | | |
|---|---|---|---|
| WO9532344 | 11/1995 | (WO) | E04B/2/86 |

OTHER PUBLICATIONS

'Lite–Form Specification' by Alberta Wilbert Sales Ltd. 2 pgs.

'Form–Fold Insulating Concrete Forms' 8/94 Lite–Form Inc. p. 3.

Liteform Insulation of Pre–Assembled or Site–Assembled Concrete Forms (undated) Alberta Wilbert Sales Ltd. p. 3.

'Diamond Snap Form' by AFM Corporation (undated).

'Diamond Snap Form Detail Book' AFM Corp. (undated).

Lite Form Corp. "How to Assemble & Use the Lite–Form Concrete Forming System . . . " (undated).

(List continued on next page.)

*Primary Examiner*—Carl D. Friedman
*Assistant Examiner*—Patrick J. Chavez

(57) ABSTRACT

Disclosed herein is a corner joint support for holding forms for casting upright concrete walls, comprising an outer form support an inner form support, the outer form support including inner and outer upright support portions joined by platforms extending therebetween, the inner form support including inner and outer upright support portions joined by platforms extending therebetween, and spacer means for positioning the inner form support relative to the outer form support.

31 Claims, 5 Drawing Sheets

U.S. PATENT DOCUMENTS

| | | | |
|---|---|---|---|
| 5,709,060 | 1/1998 | Vaughan et al. | 52/416 |
| 5,735,093 | 4/1998 | Grutsch | 52/309.11 |
| 5,782,050 | 7/1998 | Boeshart | 52/426 |
| 5,890,337 | 4/1999 | Boeshart | 52/426 |

OTHER PUBLICATIONS

"Why is Fold–Form Your Best Choice?" web page Oct. 26, 1998.

'Turn on the Lite and Bring Concrete Construction out of the Dark Ages' 1994 Lite–Form Inc.

* cited by examiner

CONCRETE WALL FORMING SYSTEM

REFERENCE TO CO-PENDING APPLICATION

United States Provisional Application entitled CORNER TIE FOR POURED CONCRETE WALL FROM SYSTEMS filed Jan. 15, 1999 under Ser. No. 60/116,201 is incorporated herein by reference.

FIELD OF INVENTION

The present invention relates generally to ties for poured concrete wall systems, and more particularly to an improved methods for securing support walls therefor.

BACKGROUND OF THE INVENTION

Wall forming systems for poured concrete walls have been used for many years. Most forms have been constructed of plywood, steel or aluminum and are typically stripped from the poured concrete wall after the concrete has sufficiently hardened. Regardless of the form material used, an inherent characteristic of these wall forming systems is the use of straight form ties to maintain the position of the forms while concrete is poured and subsequently hardened.

A recent development in this art field is the use of expanded polystyrene panels as form panels. These newer form systems utilize pairs of foam panels which are connected in a parallel, spaced apart relationship by a series of rigid plastic ties. Complete wall form systems are created by stacking the paired foam panels into larger arrays. Concrete is then poured between the panels of the completed foam wall form system. The thickness of the poured concrete walls can be adjusted by the selection and utilization of form ties of appropriate size. Subsequent to concrete hardening these foam panels may be left in place to serve as insulation or may be stripped off to reveal the concrete.

While the aforementioned straight form ties are successful for their intended purpose, it was initially necessary to utilize additional specialized framing and/or form system components at a corner junction where two walls met. U.S. Pat. No. 4,916,879 to P. E. Boeshart (issued Apr. 17, 1990; entitled "*Corner Tie*") *teaches a corner tie for use with foam wall forming systems. The disclosed corner tie has a series of spaced paddles, which are joined in pairs by a single slender spacing strap; the spacing distance between the paddles is equal to the thickness of the foam panels. Similarly joined paddle pairs are inter-connected via a network of slender straps to form the corner tie.*

The Boeshart corner tie is deficient in several respects. As taught in the patent, the series of paired paddles do not engage the edges of the foam panels to an appreciable degree, thus stability of the corner components of the foam wall form system is compromised. Moreover, the use of a simple network of slender straps to align the constituent paddle pairs of the corner tie confers a high degree of planar flexibility to the corner tie, thus imparting added instability to the aligned foam panels at corner junctions. As a result, the creation of a stable foam panel wall forming system utilizing these corner ties typically requires the use of smaller foam panels and/or the closer spacing of corner ties (and therefore a greater number of constituent foam panels and/or number of corner ties). Additionally, the use of an external bracing system to reinforce or stabilize the corner sections of the completed wall forming system is generally required.

A second deficiency of this corner tie also arises from the use of the strap network for paddle alignment. The multiplicity of straps cris-crossing the interior space of the corner tie obstructs and impedes the uniform pouring and settling of concrete in the wall forming system. As a result, the poured concrete may be honeycombed with air bubbles. These bubbles or honeycombing in the hardened concrete manifest as a decrease in wall strength and stability A third deficiency in the Boeshart corner tie is that it cannot be used in conjunction with the traditional reinforcement rods typically used in concrete wall formation.

A fourth deficiency is that this corner tie provides a minimal surface or substrate area to which drywall can eventually be fastened.

As such, there is a clear need for a corner tie which addresses at least some of the aforementioned deficiencies of the current corner ties used in foam wall forming systems.

It is an object of the present invention to provide an improved technique for forming concrete walls.

SUMMARY OF THE INVENTION

Briefly stated, the present invention provides a corner joint support for holding forms for casting upright concrete walls, comprising an outer form support and an inner form support, the outer form support including inner and outer upright support portions joined by platforms extending therebetween, the inner form support including inner and outer upright support portions joined by platforms extending therebetween, and spacer means for positioning the inner form support relative to the outer form support.

In another its aspects, the present invention provides a corner tie having four platform members connected in a generally rectangular configuration. The four platform members are located at the four corners of the generally rectangular configuration. A first platform member is connected to a second platform member via a first spacer member. The first platform member is further connected to a third platform member by a second spacer member such that the second and third platform members are located at generally opposite corners of the generally rectangular configuration. A fourth platform member is individually connected to the second and third platform members via a third and fourth spacer member, such that this fourth platform member is located generally opposite to the first platform member in the generally rectangular configuration. A brace member connects one of the platform members to the opposing platform member of the generally rectangular configuration. The corner tie may also possess engagement means for engaging the form panels. Preferably, the engagement means are slats which engage the foam form panels by sliding into slits situated therein. The platform members may also have edge members generally attached perpendicularly thereto to maintain the stability and alignment of the constituent form panels of the wall forming system. Additionally, the brace or spacer members may be arranged to provide openings for engagement of concrete reinforcements rods.

In another of its aspects, the present invention provides a corner tie for aligning adjacent upright wall sections of a concrete form, comprising:

- a plurality of upright support panels joined near their ends to form a closed ring structure and defining a concrete receiving passage therein, wherein selected pairs of the upright support panels form corner regions;
- a plurality of platforms, each joined to a pair of the upright support panels in a corresponding corner region;
- each of the platforms being arranged for receiving an upright wall section, and at least one brace member extending across the passage and attached to opposite sides of the ring structure.

Preferably, the upright support panels form a generally rectangular closed ring structure, each platform has a pair of edges and is attached to the pair of upright support panels along the edges and the brace is positioned adjacent two opposed platforms. Each of a plurality of inner abutment members is fixed to a corresponding platform, while each of the inner abutment members is spaced from at least one of the upright support panels to receive one of the upright wall sections therebetween for restraining the wall section from lateral movement relative to the platform.

Preferably, selected pairs of the platforms define a wall section receiving passage which is bordered by one of the wall sections and a pair of the abutment members, wherein another of the wall sections interrupts the wall section receiving passage. Selected abutment members include two flanges positioned at right angles to one another, wherein the wall section receiving passage is bordered by one of the flanges and one of the upright support panels. Preferably, each of the flanges is parallel with one of the upright support panels Preferably, the brace member has a pair of ends, each of which is joined at each end to one of the upright support panels at a position offset from a corresponding corner. Each end of the brace member is joined to a corresponding vertical support wall at a location substantially in common with a corresponding inner abutment member. The upright support panels extend above and below the platforms, for positioning two sets of upright wall sections.

In still another aspect of the present invention, there is provided a device for holding forms for casting upright concrete walls, comprising a first form support and a second form support, the first and second form supports each including a pair of upright support portions joined by platforms extending therebetween, spacer means for positioning the inner form support relative to the outer form support.

Preferably, an engagement means extends outwardly from each of said platforms for engaging the foam panels. The engagement means may include a slat extending from one support portion to another, a spike or some other projection for extending into a complementary passage in the foam panel.

Preferably, positioning means is also provided for positioning a reinforcement bar and may include a pair of flanges extending outwardly from said spacer means for receiving said reinforcement bar therebetween.

In still another of its aspects, the present invention provides a concrete wall form installation, comprising a plurality of panel elements wall held in an edgewise relationship to form a pair of spaced form walls to receive poured concrete therebetween, said installation including at least one corner, said installation further comprising a plurality of corner ties as defined above, wherein said platform extends between adjacent panel elements in said corner for securing said panel elements in position therein.

In still another of its aspects, the present invention provides a concrete wall form installation, comprising a plurality of panel elements wall held in an edgewise relationship to form a pair of spaced form walls to receive poured concrete therebetween said installation further comprising a plurality of devices as defined hereinabove wherein said platform extends between adjacent panel elements for securing said panel elements in position.

DESCRIPTION OF THE ILLUSTRATED EMBODIMENTS

Figure 1:
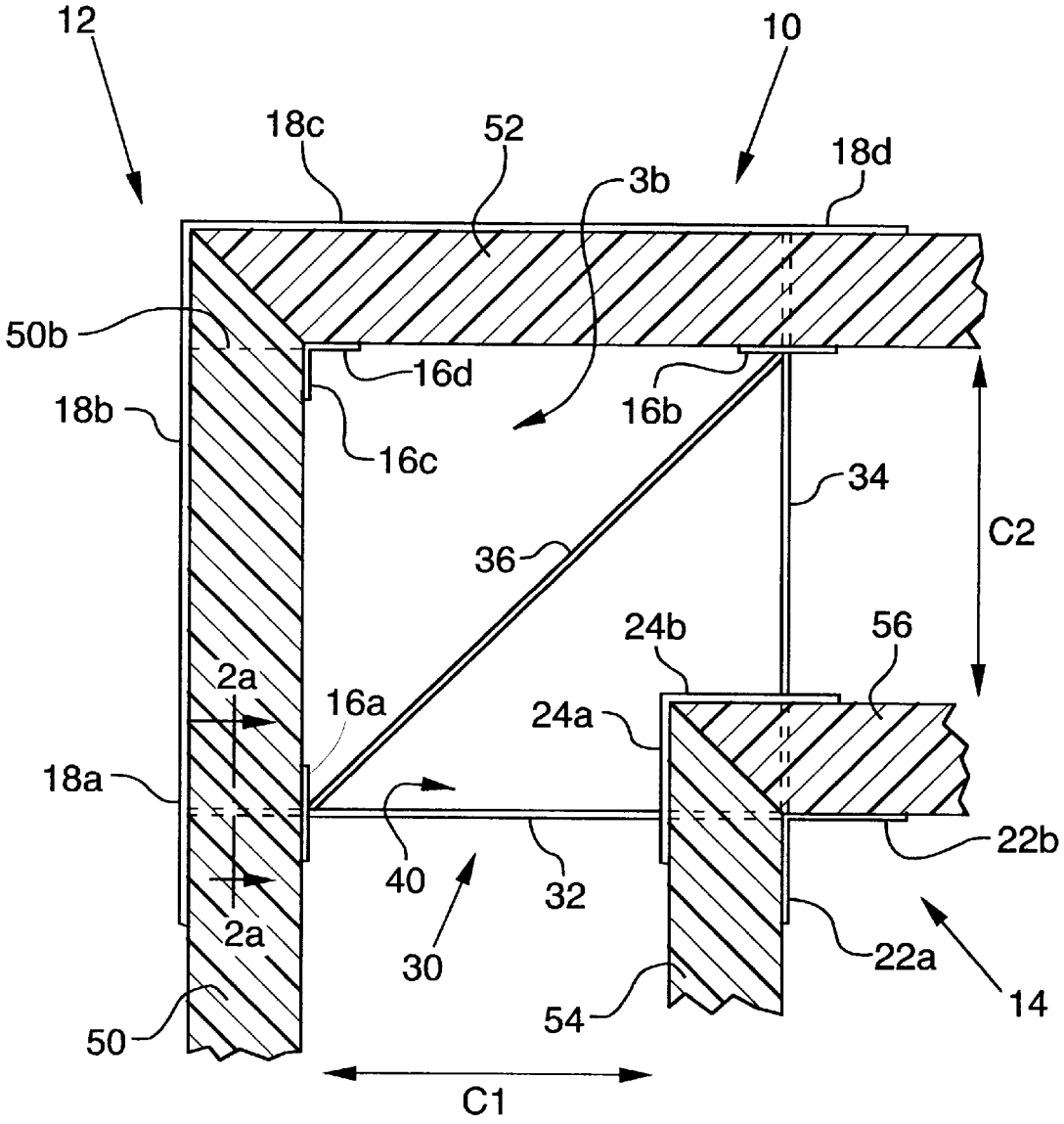
FIG. 1 is a top view of a corner tie in an operative condition.
Figure 2:
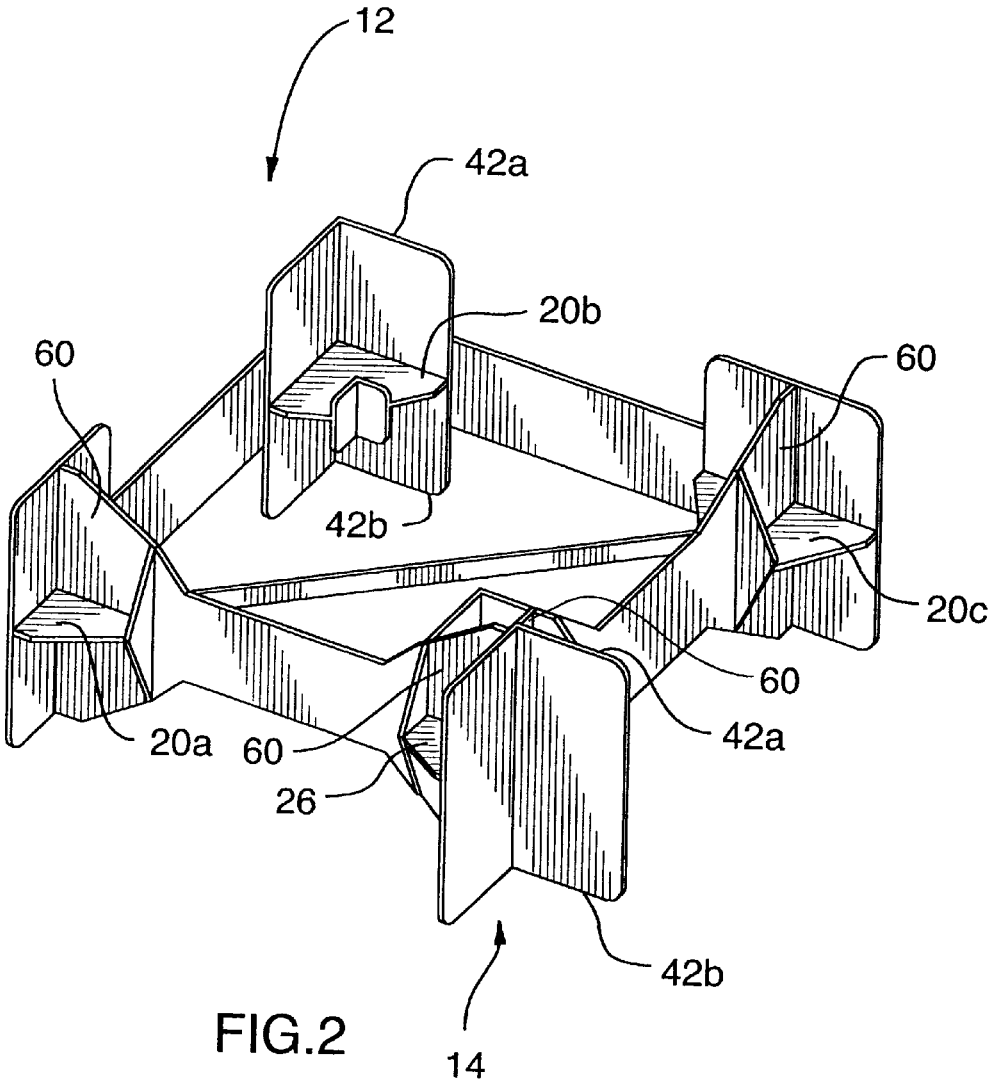
FIG. 2 is a perspective view of the corner tie of FIG. 1.
Figure 3:
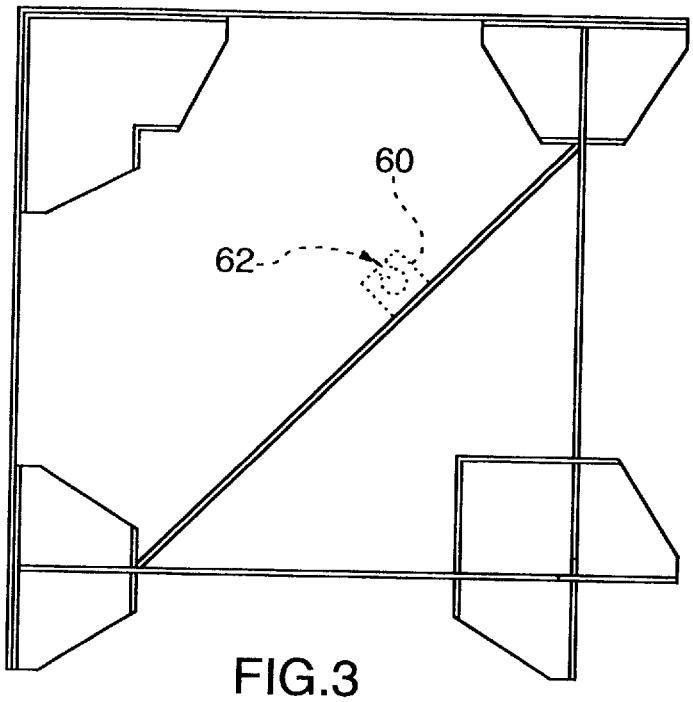
FIG. 3 is a top view of the corner tie of FIG. 1.

Referring to FIGS. 1 to 3, there is provided a corner joint support shown at 10 for holding forms for casting upright concrete walls. The corner joint support has an outer form support 12 and an inner form support 14. The outer form support includes a number of inner and outer upright support portions 16*a* to 16*d* and 18*a* to 18*d* joined by platforms 20*a* to 20*c* which extend between corresponding support portions. The inner form support 14 includes a number of, in this case two each, inner and outer upright support portions 22*a*, 22*b* and 24*a*, 24*b* respectively which are joined, in this case, by a single platform 26 extending therebetween.

Spacer means, generally shown at 30 extends between and positions the inner form support 14 relative to the outer form support 12 to form a cavity having dimensions C1 and C2, which will be substantially equal when forming two concrete walls, each with the same thickness. In this case, the spacer means 30 is in the form of a plurality of spacer elements 32, 34 and 36 which extend between opposed inner support portions 16*a*, 16*b* of the outer form support and the inner support portions 24*a*, 24*b* of the inner form support 14 to connect the support portions of the outer form supports with the outer support portions of the inner form support 14. Located between the spacer elements are two passages, shown generally at 38 and 40, for receiving concrete.

Referring to FIG. 2, it will also be seen that inner and outer support portions 16, 18 have upper and lower ends shown at 42*a*, 42*b* and the platforms 20 and 26 are intermediate the upper and lower ends.

Figure 2A:
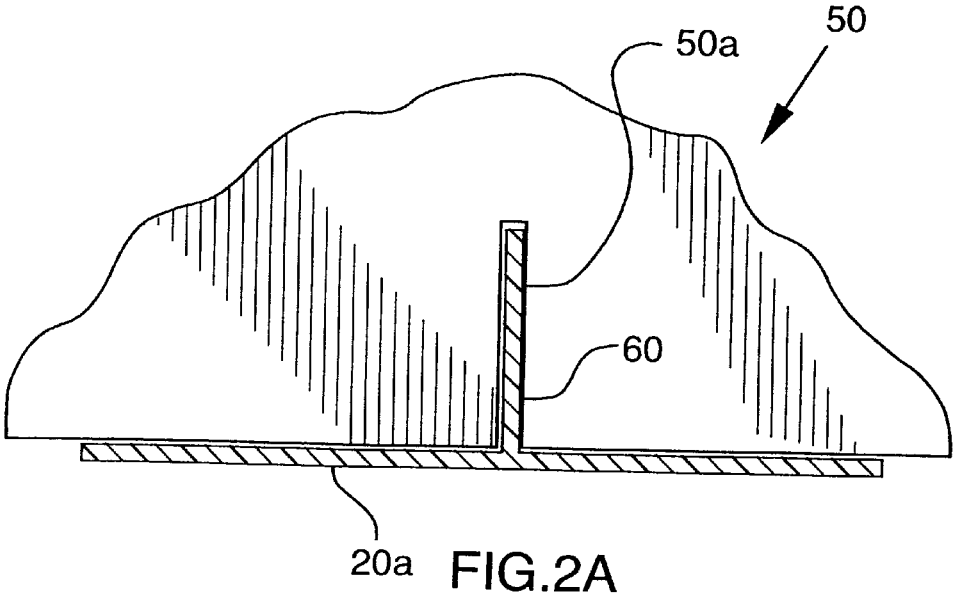
FIG. 2*a* is a sectional view taken on line 2*a*—2*a* of FIG. 1.

Referring to FIG. 2*a*, the corner tie is also provided with a number of slats which extend upwardly from the platforms 20*a*, 20*c* and 26 and which join the inner and outer support portions 16, 18 for fitting with corresponding passages in the form walls as shown at 50*a* in FIG. 2*a*.

Referring to FIG. 3, the spacer members may also be provided with a flange arrangement shown at 60 with an opening 60*a* therein to receive a reinforcement bar or the like. The flange arrangement may be placed at one of a number of locations on the spacer members so that the reinforcement bar is in its appropriate position to provide tensional strength to the formed concrete wall.

Figure 4:
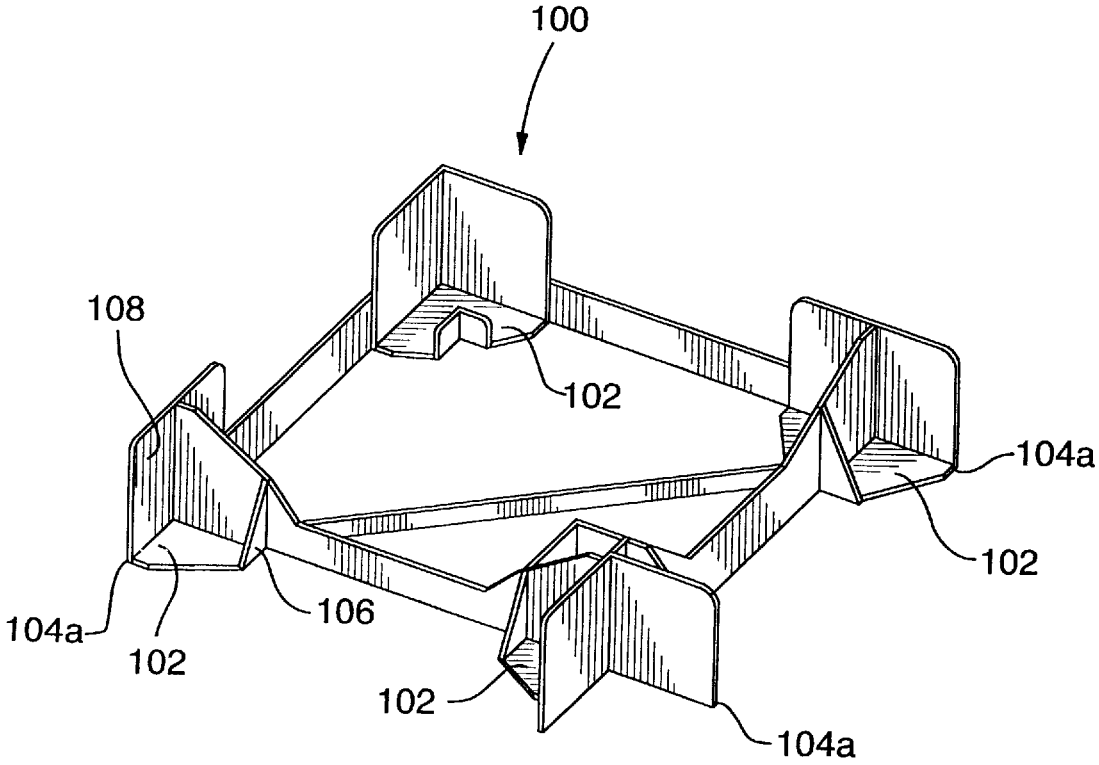
FIG. 4 is a perspective view of another corner tie.

FIG. 4 illustrates another corner tie 100 which, in this case, has platforms 102 which are positioned at the lower ends 104*a* of the inner and outer support portions shown at 106, 108.

The corner tie 10 is used in the following manner. A member of such corner ties are assembled with a corresponding number of outer form walls 50, 52 and inner form walls 54 and 56. This is done by cutting the form walls to the desired length and then forming the slots 50*a* at the appropriate locations to allow the slats 60 to fit therein. Desirably, the form walls are selected with a thickness which is sufficient to cause them to fit snugly between the inner and outer support portions and rest on the corresponding platforms, though the fit between the support portions and the form walls may be adjusted as desired. The form walls may be mitted as shown in solid lines in the figures or instead, one form wall may have a rectangular cut end to abut the side of the adjacent form wall, as shown in dashed lines at 50*b* in FIG. 1.

A number of form walls may be installed edge-wise one on another to form a composite wall. In this case, the corner tie 10 is useful because it is intended to engage two sets of form walls, namely those engaging the upper and lower segments of the support portions, that is on the upper and lower sides of the platforms. The corner tie of FIG. 4, on the other hand, is most appropriately used on the bottom of the wall being formed and only engages one set of form walls, although the corner tie could be reversed to be the uppermost corner tie for a wall construction. Once the wall construction is made, concrete may be poured through the passages 38 and 40 to fill the cavity between the inner and outer form walls, thereby to construct the concrete wall.

The slats are useful to improve the strength of the corner tie, particularly between the platforms and their associated inner and outer support portions. Furthermore, the slats significantly improve the engagement of the form walls with the platforms and inner and outer support portions, which improve the coupling of the corner tie with the panel.

It will be understood that the corner tie 10 may be used with other form walls, including those made from such materials as wood, plastics, gypsum, paper and others, or a combination thereof, provided of course that they have the strength to withstand the pressures exerted on the walls of the form by the poured concrete.

The corner tie is particularly useful because it can also position, as desired, reinforcement bar or other items to be formed within the concrete wall, such as electrical, communications or plumbing conduit and the like.

In this case, the reinforcement bar or other items may be secured directly to the spacer members or to the inner support portions by a number of well known fixture methods such as by threaded fasteners, rivets, straps and the like.

Thus the inner and outer support portions align and stabilize the foam walls in relation to each other, while the length of the spacer elements dictate the thickness of the poured concrete wall. If desired, the spacer members may be arranged so that the dimension C1 larger or smaller than the dimension C2, thereby providing concrete walls with different thicknesses, all through the selection of the spacers members with suitable lengths.

In the embodiments shown in the figures, the corner ties 10 and 100 both include four platform members spaced in a generally rectangular configuration. The platform members are generally situated at the four corners of this generally rectangular configuration and the form walls rest edgewise on platform members. The broad surface area of the platform members provides for an increased interface between the foam panels and the corner tie, thus enhancing the stability of the foam panel-corner tie engagement. The spacer members, in this case, maintain the platform members in a generally rectangular configuration relative to one another, although the platform members may be positioned in other configurations, that is to provide for the construction of other non-90° angled wall corners, that is acute or oblique angled corners. The spacer members also function to stabilize and maintain the planar aspect of corner tie.

It will be understood that the dimensions of the platforms, support portions and spacers may be selected, along with their material type, to provide varying degrees of structural resiliency, strength and so on. In this case, the spacer or brace members also contribute to the torsional resiliency of the corner tie. The spacer or brace members join, in this case, two opposing platform members 20*a* and 20*c*, although the brace member (or indeed an additional brace member) may be implemented to join the other two opposing platform members 20*b* and 26.

The inner and outer support portions are typically joined to the edges of the platform members. However, the support portions can also be joined to each other for additional support if need be. Additional spacer members may also be used, though such additional spacers may in some cases interfere with the flow of concrete through the tie The outer support portions 18*a* to 18*d* and the inner support portions 22 are also beneficial because they provide a significant surface area on the inner and outer surfaces of the so-formed concrete wall which serves as a mounting location for such things as interior and exterior claddings, such as exterior siding or interior dry wall, as well as figures such as lights and the like. The support portions may also have different configurations or sizes to those illustrated herein and such configurations will depend, in part, on the size of the concrete wall being formed, the number of conduits and the like being secured in the wall, the amount of surface area desired on the finished wall for the mounting of fixtures and panels and the like.

The corner tie provides, in one embodiment as shown in FIGS. 1 to 3, an effective tool for aligning two sets of form walls both above and below the corner tie. By contrast, the corner tie of FIG. 4 provides a tool for aligning a single set of form walls. As such, the corner tie of FIG. 4 can be used either as a base or as a top cap of a wall forming system.

Figure 5:
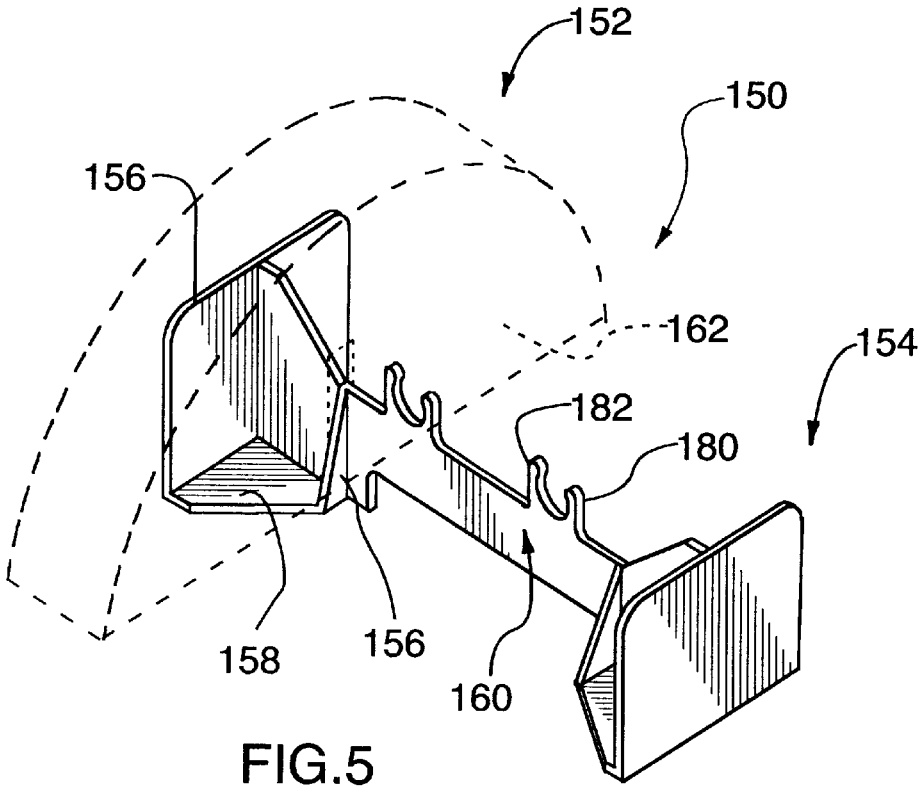
FIG. 5 is a perspective view of a device for holding forms for casting upright concrete walls.

Referring to FIG. 5, there is shown a device for holding forms for casting upright concrete walls, comprising a first form support 152 and a second form support 154, the first and second form supports each including a pair of upright support portions 156 joined by platforms 158 extending therebetween and spacer means 160 for positioning the inner form support relative to the outer form support. Engagement means is also provided for engaging the foam panels with each of the form supports and, in this case, the engagement means are slats 162 extend outwardly from each platform and between the support portions 156, 158. The device 150 in FIG. 5 is effective for aligning a single set of from walls (one being shown at 162) placed between the support portions of each form support. The device 150 in an operative condition can be seen in FIG. 7 in the wall installation 164.

Another device is shown at 166 for aligning two sets of form walls both above and below the corner tie, as shown at 168, 170 in FIG. 6. Referring to FIG. 7 the form walls 170, 172 have upper and lower surfaces with recesses shown at 172*a*, 174*a*, which are approximately the size of the platforms. This allows the platforms to seat within the recesses to improve further the engagement of the devices 150 and 166 with the form walls, if desired. The recesses are also useful to maintain the edges of the form walls to be relatively close together to minimize seepage of poured cement therethrough.

Figure 6:
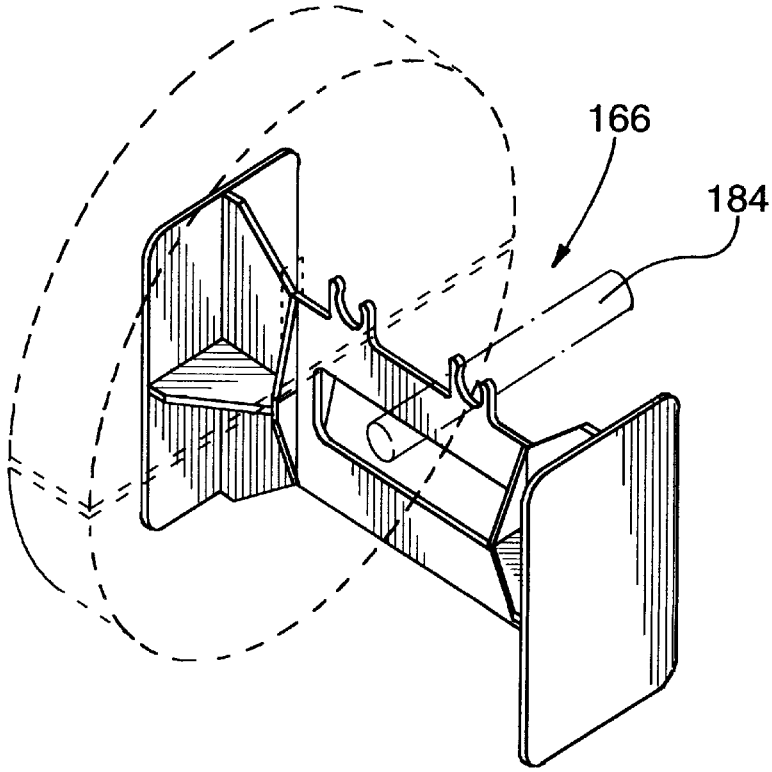
FIG. 6 is a perspective view of another device for holding forms for casting upright concrete walls.
Figure 7:
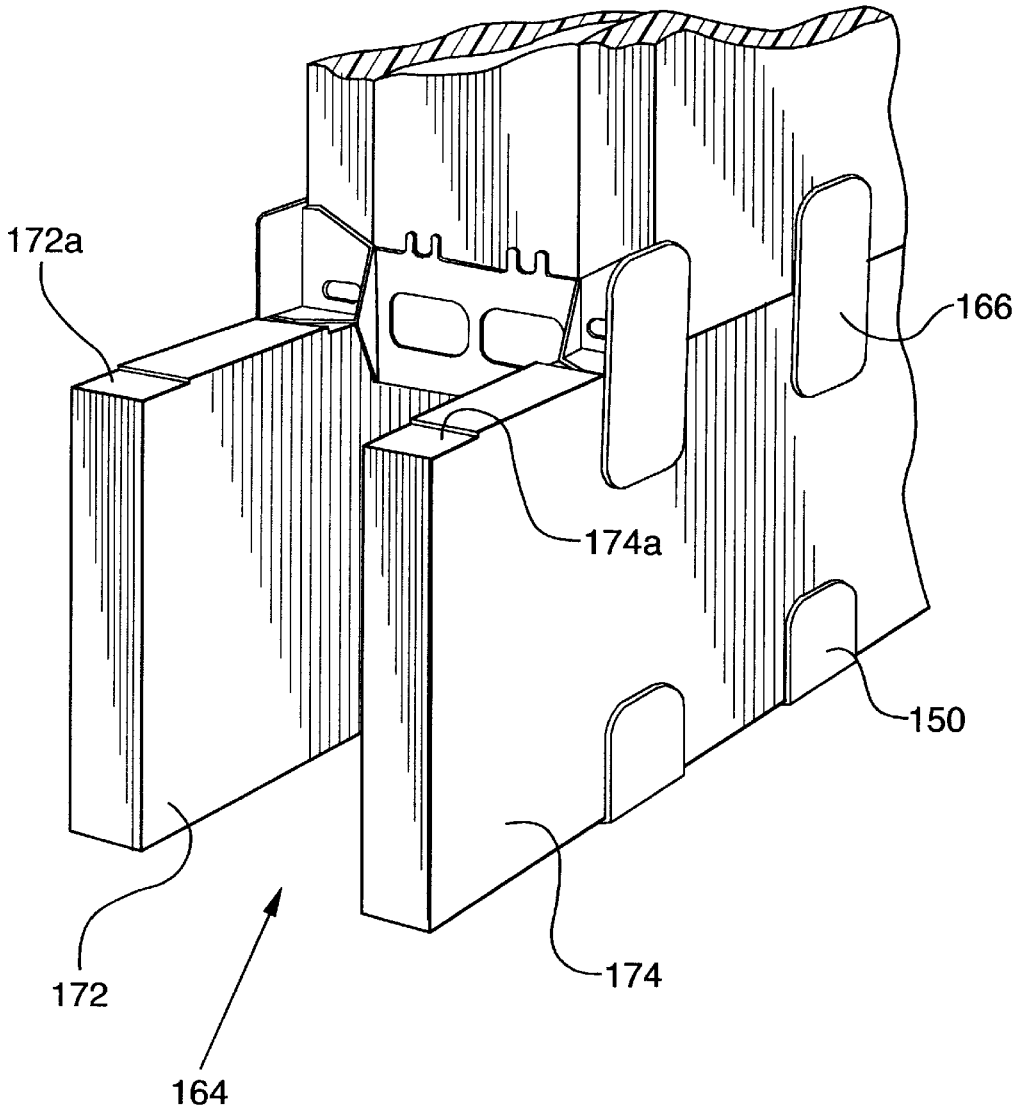
FIG. 7 is a perspective view of a concrete wall form installation.

The devices 150 and 166 are also provided with positioning means for positioning a reinforcement bar, which in this case includes a pair of flanges 180, 182 extending outwardly from said spacer means for receiving said reinforcement bar therebetween, as shown in chain-dotted lines at 184 in FIG. 6.

Whereas the invention has been shown and described in connection with the preferred embodiments thereof, it will be understood that many modifications, substitutions and additions may be made in addition to those herein described which are within the broad scope of the claims and would be readily evident to those skilled in the art. Accordingly, all suitable modifications and equivalents may be resorted to, and are considered as falling within the scope of the invention.

I claim:

1. A corner joint support for holding forms for casting upright concrete walls, comprising:

a) an outer form support and an inner form support;

b) the outer form support including inner and outer upright support portions joined by a platform extending there between;

c) the inner form support including inner and outer upright support portions joined by a platform extending there between;

d) an engagement member located between the inner and outer upright support portions for inhibiting relative lateral movement between the support portions and the forms when placed there between; and e) spacer means for positioning the inner form support relative to the outer form support;

wherein the platform including a generally horizontal platform for inhibiting relative vertical movement between the form and the support portions.

2. A corner joint as defined in claim 1 wherein said spacer means further includes a passage for receiving concrete there through.

3. A corner joint as defined in claim 1 wherein said spacer means comprises a plurality of spacer elements connecting the support portions of said outer form with the support portions of said inner form support.

4. A corner joint as defined in claim 1 wherein said spacer means further comprises a plurality of spacer elements extending between opposed inner support portions of said outer form support and the inner support portions of said outer form support.

5. A corner joint as defined in claim 1 wherein said support portions have upper and lower ends, and said platforms are intermediate said upper and lower ends.

6. A corner tie for interlocking the ends of parallel, spaced apart form panels which intersect a second pair of parallel, spaced apart form panels, comprising:

a) four generally horizontal platform members connected in a generally rectangular configuration, the platform members extending between respective pairs of inner and outer upright support portions for receiving the form panels there between, wherein said generally horizontal platform members are located at the corners of said generally rectangular configurations;

b) a first generally horizontal platform member connected to a second generally horizontal platform member by a first spacer member;

c) the first generally horizontal platform member further connected to a third generally horizontal platform member by a second spacer member, such that said second and third generally horizontal platform members are located at generally opposite corners of the generally rectangularly configuration;

d) a fourth generally horizontal platform member connected to the second platform member via a third spacer member;

e) said fourth generally horizontal platform member connected to the third generally horizontal platform member by a fourth spacer member, such that said fourth generally horizontal platform member is located at the corner generally opposite to the first generally horizontal platform member in a generally rectangularly configuration;

f) an engagement member located between the inner and outer upright support portions for inhibiting relative lateral movement between the support portions and the forms when placed there between; and g) a brace member connecting any two opposing platform members of a generally rectangular configuration, wherein the generally horizontal platform members for inhibiting relative vertical movement between the form panels and the support portions.

7. The corner tie of claim 6 wherein at least one of the platform members possesses the engagement member for engaging the foam panels.

8. The corner tie of claim 6 where the engagement member comprises slats extending in a generally perpendicular manner from the platform members.

9. The corner tie of claims 6 wherein at least one of the platform members further comprises at least one edge member joined to the platform member.

10. The corner tie of claim 9 wherein the edge member is a paddle.

11. The corner tie of claim 10 wherein the edge member is joined in a generally perpendicular manner to the platform member.

12. The corner tie of claim 10 further comprising a pair of joined edge members, said pair of joined edge members consisting of a first edge member joined in an angular relationship to a second edge member, said first and second edge members also being joined to a common platform member.

13. The corner tie of claim 12 wherein the angular relationship is generally perpendicular.

14. The corner tie of claims 12 wherein at least one of the platform members further comprises at least two pairs of joined edge members.

15. The corner tie of claim 6 wherein the brace member has openings for engagement of concrete reinforcement bars.

16. The corner tie of claim 6 wherein at least one of the spacer members has openings for engagement of concrete reinforcement bars.

17. A corner tie for aligning an adjacent upright wall section of a concrete form comprising:

a) a plurality of upright support panels joined near their ends to form a closed ring structure and defining a concrete passage therein, wherein selected pairs of said upright support panels form corner regions;

b) a plurality of platforms, each joined to a pair of said upright support panels in a corresponding corner region to form a space there between to receive the upright wall section;

c) each of said platforms being arranged for receiving the upright wall section;

d) an engagement member located between the inner and outer upright support portions for inhibiting relative lateral movement between the support portions and the wall sections when placed there between; and e) at least once brace member extending across passage and attached to opposite sides of said ring structure for maintaining a spaced apart relationship of the corner regions of said closed ring structure;

wherein the platforms including a generally horizontal platform for inhibiting relative vertical movement between the wall sections and the support panels.

18. A corner tie as defined in claim 17 wherein said upright support panels form a generally rectangular closed ring structure.

19. A corner tie as defined in claim 17 wherein each platform has a pair of edges and is attached to said pair of upright support panels along said edges.

20. A corner tie as defined in claim 17 wherein said brace is positioned adjacent two opposed platforms.

21. A corner tie as defined in claim 17 further comprising a plurality of the engagement members, each of which is fixed to a corresponding platform, each of the engagement members to be spaced from at least one of said upright support panels to receive one of said upright wall sections there between for restraining said wall section from lateral movement relative to said platform.

22. A corner tie as defined in claim 21 wherein selected pairs of said platforms define a wall section receiving passage which is bordered by one of said wall sections and a pair of the engagement members, wherein another of said wall sections interrupts said wall section receiving passage.

23. A corner tie as defined in claim 22 wherein selected engagement members include two flanges positioned at right angles to one another, wherein said wall section receiving passage is bordered by one of said flanges and one of said upright support panels.

24. A corner tie as defined in claim 23 wherein each of said flanges is parallel with one of said upright support panels.

25. A corner tie as defined in claim 20 wherein said brace member has a pair of ends, each of which is joined at each end to one of said upright support panels at a position offset from a corresponding corner.

26. A corner tie as defined in claim 25 wherein each end of said brace member is joined to a corresponding vertical support wall at a location substantially in common with the corresponding engagement member.

27. A corner tie as defined in claim 17 wherein said upright support panels extend above and below said platforms, for positioning two sets of upright wall sections.

28. A support as defined in claim 1 wherein each of the inner and outer upright support portions of the outer form support include two pairs of upright panels, each panel being joined at an intersection to form a corner, wherein the generally horizontal platforms extend between the two pairs of upright panels.

29. A support as defined in claim 28 wherein the generally horizontal platforms extend substantially continuously along the entire generally horizontal dimension of the upright panels.

30. A support as defined in claim 1, wherein the outer form support includes an outer pair of upright panels joined at an outer corner and an inner pair of upright panels joined an inner corner and a generally horizontal platform extending between both of the outer pair of panels and both of the inner pair of panels.

31. A support as defined in claim 30 wherein the other form support includes at least one second pair of inner and outer upright support portions which are joined by a horizontal platform extending there between.

* * * * *